US009499773B2

(12) United States Patent
Simonsen

(10) Patent No.: US 9,499,773 B2
(45) Date of Patent: Nov. 22, 2016

(54) ENZYME PARTICLES COMPRISING A VINYL PYRROLIDONE/VINYL ACETATE COPOLYMER

(75) Inventor: Ole Simonsen, Soeborg (DK)

(73) Assignee: NOVOZYMES A/S, Bagsvaerd (DK)

( * ) Notice: Subject to any disclaimer, the term of this patent is extended or adjusted under 35 U.S.C. 154(b) by 0 days.

(21) Appl. No.: 13/343,161

(22) Filed: Jan. 4, 2012

(65) Prior Publication Data

US 2012/0108491 A1 May 3, 2012

Related U.S. Application Data

(63) Continuation of application No. 12/521,658, filed as application No. PCT/EP2008/050285 on Jan. 11, 2008, now abandoned.

(60) Provisional application No. 60/885,427, filed on Jan. 18, 2007.

(30) Foreign Application Priority Data

Jan. 11, 2007 (DK) ..... 2007 00039

(51) Int. Cl.
*C11D 3/386* (2006.01)
*C11D 3/22* (2006.01)
*C11D 3/37* (2006.01)

(52) U.S. Cl.
CPC ..... *C11D 3/38672* (2013.01); *C11D 3/222* (2013.01); *C11D 3/225* (2013.01); *C11D 3/37* (2013.01); *C11D 3/3776* (2013.01)

(58) Field of Classification Search
USPC ..... 3/386; 9/225; 11/17; 17/39
See application file for complete search history.

(56) References Cited

U.S. PATENT DOCUMENTS 3,860,484 A * 1/1975 O'Malley ..... 435/188
4,411,999 A * 10/1983 Shigesada et al. ..... 435/177
4,572,897 A 2/1986 Amotz
4,777,089 A 10/1988 Takizawa
4,908,233 A 3/1990 Takizawa
5,093,021 A * 3/1992 Coyne et al. ..... 510/530
5,198,353 A 3/1993 Hawkins
5,312,883 A 5/1994 Komatsu
5,317,063 A 5/1994 Komatsu
5,324,649 A 6/1994 Arnold
5,384,189 A 1/1995 Kuroda et al.
5,739,091 A * 4/1998 Kiesser et al. ..... 510/224
5,846,798 A * 12/1998 Paatz et al. ..... 435/187
5,846,927 A 12/1998 Vasudevan
5,879,920 A * 3/1999 Dale et al. ..... 435/187
5,900,247 A 5/1999 Rault
6,025,316 A * 2/2000 Cao et al. ..... 510/360
6,423,517 B2 * 7/2002 Becker et al. ..... 435/187
6,713,414 B1 3/2004 Pomplun et al.
6,713,533 B1 3/2004 Panzer
6,933,141 B1 * 8/2005 Bach ..... A21D 8/042 435/183
7,070,854 B2 7/2006 Chang
2001/0031717 A1 * 10/2001 Dale ..... C11D 3/382 510/392
2002/0082183 A1 * 6/2002 Christensen, Jr. ..... C11D 3/14 510/392
2002/0103095 A1 8/2002 Becker
2002/0160927 A1 10/2002 Markussen
2002/0193275 A1 * 12/2002 Christensen, Jr. ..... C11D 3/14 510/445
2003/0129717 A1 7/2003 Becker
2004/0198629 A1 * 10/2004 Raehse et al. ..... 510/447
2004/0229329 A1 * 11/2004 Becker et al. ..... 435/174
2005/0054065 A1 3/2005 Barendse
2006/0094097 A1 * 5/2006 Becker et al. ..... 435/182
2007/0111920 A1 * 5/2007 Baur et al. ..... 510/445
2009/0156454 A1 * 6/2009 Schmiedel ..... C11D 3/38672 510/302
2009/0163398 A1 * 6/2009 Miyamoto ..... C11D 3/046 510/224
2009/0291483 A1 * 11/2009 Bach ..... A21D 8/042 435/187

FOREIGN PATENT DOCUMENTS

EP 356239 * 2/1990
EP 0356239 A2 2/1990
EP 0672102 B1 6/1996
GB 1390503 4/1975
GB 1483542 8/1977
WO WO 97/39116 A1 10/1997
WO 97/41837 A2 11/1997
WO WO 00/01793 A1 1/2000
WO 02/081616 A1 10/2002
WO 02/096551 A1 12/2002
WO 2004/003188 A2 1/2004
WO 2005/063365 A1 7/2005
WO 2010003934 A1 1/2010

* cited by examiner

*Primary Examiner* — Charles Boyer
(74) *Attorney, Agent, or Firm* — Kristin McNamara

(57) ABSTRACT

The present invention relates to a particle comprising an enzyme and a polymer wherein the enzyme and polymer is present as a mixture in the particle and the polymer is substantially soluble in an aqueous solution having an ionic strength of 0 mol/kg and insoluble in an aqueous solution having an ionic strength of more than 1 mol/kg according to method 1 of the invention.

14 Claims, No Drawings

ENZYME PARTICLES COMPRISING A VINYL PYRROLIDONE/VINYL ACETATE COPOLYMER

CROSS-REFERENCE TO RELATED APPLICATIONS

This application is a continuation of U.S. patent application Ser. No. 12/521,658 filed Jun. 29, 2009 which is a 35 U.S.C. 371 national application of PCT/EP2008/050285 filed Jan. 11, 2008, which claims priority or the benefit under 35 U.S.C. 119 of Danish application no. PA 2007 00039 filed Jan. 11, 2007 and U.S. provisional application No. 60/885,427 filed Jan. 18, 2007, the contents of which are fully incorporated herein by reference

FIELD OF THE INVENTION

The present invention relates to particles comprising a mixture of enzyme and polymer. The present invention further relates to liquid formulations comprising the particles of the invention.

BACKGROUND OF THE INVENTION

Particles comprising active compounds such as enzymes and encapsulated with polymeric containing materials are known in the art:

U.S. Pat. No. 6,713,533 describes nanocapsules with cross linked polymer envelope useful for transport of biologically active compounds and diagnostic agents.

WO 2005063365 describes hollow structured free standing membrane useful in enzyme immobilization or drug delivery.

WO 2002096551 describes soluble nano- or micro-capsules, used for e.g. packaging and releasing active substances, or detergents, comprising polymers wherein the polymer is a polyampholyte.

WO 9741837 relates to the preparation of biodegradable microparticles comprising a polymer matrix containing an active compound.

GB 1483542 describes microcapsules prepared from gum arabic, gelatin and natural polymer.

GB 1390503 relates to polymer gels which are insoluble in liquid detergents but are released when diluted with water. This application is not related to particles comprising enzymes.

EP 0356239 is related to dispersion of polymer/enzyme particles in a liquid phase suitable for use in liquid detergents.

U.S. Pat. No. 5,198,353 relates to a method for preparing a stabilized enzyme dispersion.

Water soluble polymers which are sensitive to salts are known from U.S. Pat. No. 5,312,883, U.S. Pat. No. 5,317,063 and U.S. Pat. No. 7,070,854.

EP 0672102 relates to polymer capsules comprising a hydrophobic polymer core and a hydrophilic polymer which is attached to the hydrophobic core.

U.S. Pat. No. 4,908,233 relates to a process for producing microcapsules by dispersing a insoluble material in an aqueous dispersion comprising two different water soluble polymers.

U.S. Pat. No. 4,777,089 discloses a microcapsule containing a hydrous composition comprising at least one electrolyte and a microcapsule comprising a core material coated with a water soluble polymer.

SUMMARY OF THE INVENTION

One object of the present invention is to provide particles comprising proteins in particular enzymes, with improved storage stability, for liquid compositions such as liquid detergents.

It has surprisingly been found that it is possible to improve the storage stability of proteins such as enzymes by preparing polymer matrix particles comprising the enzyme.

The present invention provides thus in a first aspect a particle comprising an enzyme and a polymer wherein the enzyme and polymer is present as a mixture in the particle and the polymer is substantially soluble in an aqueous solution having an ionic strength of 0 mol/kg and insoluble in an aqueous solution having an ionic strength of more than 1 mol/kg according to method 1.

DETAILED DESCRIPTION OF THE INVENTION

Definitions

Ionic Strength ionic strength, I, is defined as, on a molality basis, $$I = \frac{1}{2}\sum_{j=1}^{n} m_j z_j^2$$

where the sum goes over all the ions j.

$z_j$ is the charge number of ion j.

$m_j$ is the molality in mol/kg of ion j.

Electrolyte

An electrolyte is a chemical compound that ionizes when dissolved or molten to produce an electrically conductive medium.

Method 1:

Method 1 is used to determine the solubility of a polymer as a function of ionic strength.

The polymer is dissolved in pure water e.g. as a 10% solution. A $Na_2SO_4$ solution is prepared in pure water so that after mixing the polymer solution with the $Na_2SO_4$ solution the resulting mixture contain 1% w/w polymer and a concentration of $Na_2SO_4$ according to the following table:

| Ionic strength mol/kg | % w/w $Na_2SO_4$ |
|---|---|
| 0.0 | 0.0 |
| 0.25 | 1.183 |
| 0.5 | 2.367 |
| 1.0 | 4.733 |
| 1.5 | 7.100 |
| 2.0 | 9.467 |
| 4.0 | 18.933 |

The two solutions both having a temperature of 25° C. are mixed at 25° C. to a total of 100 g and stirred for 30 minutes.

If large precipitate/aggregates/lumps are obtained the polymer is insoluble. If the mixture is homogeneous, either clear or hazy, the turbidity is measured by an instrument called a nephelometer and is measured in Nephelometric Turbidity Units (NTU), see U.S. EPA method 180.1. ΔNTU is calculated as the NTU of the polymer/$Na_2SO_4$ mixture minus the NTU of the same concentration of $Na_2SO_4$ without polymer both measured at 25° C. If ΔNTU is 3.0 or below the polymer is defined as soluble at the current ionic strength.

I.e.:

Polymer is insoluble if large visual precipitates, aggregates or lumps occur or ΔNTU>3.0

Polymer is soluble if no visual precipitates, aggregates or lumps occur and ΔNTU≤3.0

A preferred polymer is soluble at an ionic strength of 0 mol/kg, but insoluble at an ionic strength of 1 mol/kg.

Introduction

The stability of enzymes comprised in particles is influenced by the surrounding environment upon storage, being chemical or physical factors decreasing the stability.

It is known to be difficult to keep proteins stable in liquid formulations comprising protein hostile compounds, e.g. stabilizing enzymes in liquid detergents. Another problem for enzymatic liquid detergents is that they usually contain proteolytic enzymes which digest proteins, thus other enzymes present in the liquid detergent might be inactivated by present proteases wherein both proteolysis and autoproteolysis might occur.

There have been several attempts to prepare enzyme particles, suitable for liquid formulations such as liquid detergents. One problem these particles have is the turbidity of the liquid formulations after addition of the particles, due to the light scattering of the relatively large particles. It may be of importance that the particles do not or only slightly change appearance of the liquid formulation after addition and that they have a decreased tendency to sediment.

It may furthermore be of importance that the enzyme is released at the right time, e.g. for a liquid detergent that the enzyme is released upon contact with the wash water.

To use particles comprising a mixture of polymer and enzyme in liquid formulations instead of usual liquid enzyme products have several advantages; it is possible to keep enzyme hostile compounds away from the enzyme until the activity of the enzyme is needed and it is possible to avoid the enzyme to be in direct contact with compounds in the liquid which activates the enzyme. It has surprisingly been found that formulation of particles comprising a mixture of polymer and enzyme can improve storage stability of the enzyme(s) in liquid formulations such as detergents, and furthermore if smaller sized particles are used they are practically invisible in the formulation. Due to their small size the particles of the invention do not sediment and due to the structure of the particles, the enzyme is not in direct contact with hostile compounds in the environment and enzyme sensitive compounds in the surrounding liquid are not in direct contact with the enzyme. Enzyme sensitive compounds could be lipids towards lipases or proteins towards proteases.

It is important that the enzyme gets released into the media where it is supposed to work. With regard to detergents it is important that the enzyme is released when the detergent is diluted by water during the wash process. This is ensured by the properties of the release system which in this case is the polymer.

The Particle

The present invention relates to a particle comprising a polymer and an enzyme. The polymer and enzyme are present within the particle as a mixture.

The particle of the invention has preferably a particle size between 50 nm to 500,000 nm. It has been found that using small particles in liquid formulation exhibit several advantages; the particles do not sediment and if small enough they are not, or only slightly, visible in the liquid. Thus in a particular embodiment of the present invention the particle size is below 100,000 nm. In a more particular embodiment of the present invention the particle size is below 10,000 nm. In a more particular embodiment the particle size is less than 5,000 nm. In a more particular embodiment of the present invention the particle size is less than 1,000 nm. In an even more particular embodiment of the present invention the particle is less than 800 nm. In another particular embodiment the particle size is less than 500 nm. In a most particular embodiment the particle size is less than 300 nm.

In a particular embodiment the particle size is between 50 to 500 nm.

For further protection the particles of the invention may be coated. The particle may in a particular embodiment of the present invention comprise at least one coating.

The particle may comprise additional materials.

The Polymer

The polymer of the present invention is insoluble in concentrated liquid compositions such as liquid detergents but soluble when diluted with water. With regard to liquid detergent compositions this means the enzyme is isolated from the rest of the detergent components until the detergent is diluted with water during the wash process, whereupon the enzyme is released into the wash water. Suitable polymers of the invention are sensitive to the ion strength of the surroundings.

The polymer of the present invention is in a particular embodiment substantially soluble in an aqueous solution having an ionic strength of 0 mol/kg and insoluble in an aqueous solution having an ionic strength of more than 1 mol/kg according to method 1.

The polymer to be used in the invention is in a particular embodiment a modified water-soluble polymer that can be precipitated by an electrolyte. This choice of polymer allows the enzyme to be released by diluting, the liquid formulation comprising the particles, with water.

The molecular weight of the polymer (weight average) is in particular between 1,000 and 1,500,000. For good stabilization the molecular weights (weight average) are particularly below 1,000,000, e.g. below 800,000, especially below 200,000 and most particularly below 100,000. In a particular embodiment the molecular weights (weight average) are above 5,000, especially above 10,000, more particularly above 20,000, e.g. above 25,000.

To obtain sufficient stabilization it is generally preferred to have an amount of polymer corresponding to a weight ratio of polymer:enzyme (pure enzyme protein) above 0.03, e.g. above 0.1, especially above 0.4 and particularly above 1. If the polymer is used only for enzyme stabilization it is preferred to have a polymer:enzyme ratio below 5, especially below 2, but a larger amount of polymer may be used if it also serves another function (e.g. PVA or CMC for anti-redeposition in detergent).

The polymer of the invention can either be branched or non-branched. It is believed that a branched polymer is better at keeping the enzyme enclosed in a polymer matrix compared to a non-branched polymer especially due to steric hindrance. Thus in a particular embodiment of the present invention the polymer is branched.

The degree of branching of a branched molecule may be expressed in terms of the number of actual growth directions compared to the maximum number of possible growth directions. Degree of branching is defined as $$DB = \frac{R}{R_{max}}$$

Wherein R describes the number of deviations from the linear direction. DB is also described in Acta Polymer, 48, 30-35 (1997).

In a particular embodiment of the present invention the polymer has a degree of branching above 1%. In a more particular embodiment of the present invention the polymer has a DB of more than 5%. In a further embodiment of the present invention the polymer has a DG of more than 15%.

The enzyme and polymer is in a particular embodiment not covalently bound to each other.

The polymer of the present invention is generally a hydrophobically modified polymer.

One way of obtaining a polymer of the present invention is to modify a hydrophilic polymer with a hydrophobic polymer, monomer or hydrophobic groups or visa versa to modify a hydrophobic polymer with a hydrophilic polymer, monomer or hydrophilic groups. Hydrophobic modification can also be achieved by co-polymerizing at least one hydrophobic monomer, in particular at least one hydrophobic monoethylenically unsaturated (vinylic) monomer with at least one hydrophilic monomer, in particular at least one hydrophilic monoethylenically unsaturated monomer.

The preparation of the polymer can be done by grafting, cross-linking, co-polymerisation, including random co-polymeriziation and block-co-polymerisation or any suitable technique known in the art.

Hydrophobic polymers may include but are not limited to hydrogenated castor oil (HCO), ethylcellulose, polyvinylacetate, polyvinyl chloride, silicone, polypropylene oxide, polyethylene, polypropylene, polycarbonate, polystyrene, polysulfone, polyphenylene oxide and/or polytetramethylene ether.

Hydrophilic polymers may include but are not limited to polyvinylpyrrolidone, polyvinylalcohol, polyethyleneglycol, hydroxypropylcellulose, hydroxymethylcellulose, hydroxypropylmethylcellulose, gelatin, polyvinylmethylether, polymethyloxazoline, polyethyloxazoline, polyhydroxypropyloxazoline, carrageenan, polyhydroxypropylmethacrylamide, polymethacrylamide, polydimethyllacrylamide, polyhydroxypropylmethacrylate, polyhydroxyethylacrylate, hydroxymethylcellulose, hydroxyethylcellulose, polyethyleneglycol, polyaspartamide, polyethyleneoxide (PEO), and polysaccharides.

In a particular embodiment of the present invention the modified polymer may be selected from but is not limited to the group consisting of a hydrophobically modified polyvinyl pyrrolidone (PVP), hydrophobically modified polyvinyl alcohol (PVA), hydrophobically modified cellulose derivatives such as carboxymethyl cellulose, methyl cellulose and/or hydroxypropyl cellulose, carrageenan, gum such as guar gum, gum benzoin, gum tragacanth, gum arabic and/or gum acacia, protein such as casein, gelatin and/or albumin.

In a particular embodiment of the present invention the modified polymer is a modified polyvinyl pyrrolidone such as a copolymer of vinyl pyrrolidone and at least one hydrophobic co-monomer in particular vinyl acetate.

The hydrophobic monomer is generally a vinylic monomer having reduced solubility in water, in particular a solubility in water of not more than 80 g/l, in particular not more than 50 g/l at 25° C. and 1 bar. The hydrophobic monomer may be selected from the group consisting of but is not limited to C1-C18 alkyl acrylates and methacrylates such as ethyl acrylate, butyl acrylate, isobutyl acrylate, hexyl, acrylate, heptyl acrylate, methyl methacrylate, ethyl methacrylate, butyl methacrylate, isobutyl methacrylate, hexyl methacrylate, heptyl methacrylate, 1,3-butadiene, C3-C18 cycloalkyl acrylates and methacrylates such as cycloalkyl acrylate, isobornyl acrylate, isobornyl methacrylate and cycloalkyl methacrylate, C3-C18 alkylacrylamides and methacrylamides, acrylonitrile, methacrylonitrile, vinyl C1-C18 alkanoates, such as vinyl acetate, vinyl propionate, vinyl butyrate, vinylesters of versatic acid and vinyl valerate, C2-C18 alkenes, C2-C18 haloalkenes, styrene, (lower alkyl)styrene, d-methylstyrene, C2-C12 alkyl vinyl ethers, such as vinyl ethyl ether, C2-C10 perfluoro-alkyl acrylates and methacrylates, partially fluorinated acrylates and methacrylates, such as trifluoroethyl methacrylate, hexafluoroisopropyl methacrylate, hexafluorobutyl methacrylate, C3-C12 perfluoroalkylethylthiocarbonylaminoethyl acrylates and methacrylates, such as perfluorohexyl ethylthiocarbonylaminoethyl methacrylate, acryloxy- and methacryloxyalkylsiloxanes, such as tristrimethylsilyloxysilylpropyl methacrylate (TRIS), and 3-methacryloxypropylpentamethyldisiloxane, N-vinylcarbazole, bis-C1-C12 alkyl esters of maleic acid, fumaric acid, itaconic acid, mesaconic acid, such as dimethylfumarate, dimethylmaleate, dibutyl maleate and dibutyl fumarate, chloroprene, vinyl chloride and vinylidene chloride. Preferred hydrophobic monomers are selected from the group of the aforementioned acrylates and methacrylates, in particular C1-C18 alkyl acrylates and methacrylates, C3-C18 cycloalkyl acrylates and methacrylates and vinyl C1-C18 alkanoates.

The hydrophilic monomer is generally a vinylic monomer having increased solubility in water, in particular a solubility in water of more than 80 g/l, in particular more than 100 g/l at 25° C. and 1 bar. The hydrophilic monomer may be selected from the group consisting of but is not limited to hydroxyl-substituted lower alkyl acrylates and methacrylates, such as hydroxyethyl acrylate and -methacrylate, hydroxypropyl acrylate and methacrylate, acrylamide, methacrylamide, (lower alkyl)acrylamides and methacrylamides, N,N-dialkyl-acrylamides, ethoxylated acrylates and methacrylates such as polyethyleneglycol-mono acrylates and methacrylates and polyethyleneglycolmonomethylether acrylates and methacrylates, hydroxyl-substituted (lower alkyl)acrylamides and methacrylamides, hydroxyl-substituted lower alkyl vinyl ethers, sodium vinylsulfonate, sodium styrenesulfonate, 2-acrylamido-2-methylpropanesulfonic acid, N-vinylpyrrole, N-vinyl-2-pyrrolidone, 2-vinyloxazoline, 2-vinyl-4,4'-dialkyloxazolin-5-one, 2- and 4-vinylpyridine, amino(lower alkyl) (where the term amino also includes quaternary ammonium), mono(lower alkylamino) (lower alkyl) and di(lower alkylamino) (lower alkyl)acrylates and methacrylates, allyl alcohol, 3-trimethylammonium 2-hydroxypropylmethacrylate chloride, vinylpyrrolidone, vinylalcohol, acrylonitrile, acryloylchloride, ethylene glycol acrylate, methylol acrylamide, diacetone acrylamide, styrene sulfonic acid salt, dimethylaminoethyl methacrylate (DMAEMA), dimethylaminoethylmethacrylamide, and N-(1,1-dimethyl-3-oxobutyl)-acrylamide.

In a particular embodiment of the present invention the polymer is a copolymer comprising at least one hydrophobic monomer and at least one hydrophilic monomer selected from the above mentioned monomers.

In a particular embodiment of the invention the hydrophilic monomer is selected from neutral monomers (i.e. non-ionic monomers having no acidic or basic group), cationic or basic monomers (i.e. monomers having a cationic or basic nitrogen atom) and mixtures thereof and mixtures thereof with acidic monomers.

In a particular embodiment of the present invention the polymer comprises 35-95% w/w of hydrophilic monomers.

In a more particular embodiment of the present invention the polymer comprises 40-80% w/w of hydrophilic monomers. In a most particular embodiment of the present invention the polymer comprises 50-70% w/w of hydrophilic monomers.

In a particular embodiment of the present invention the polymer comprises 5-65% w/w of hydrophobic monomers. In a more particular embodiment of the present invention the polymer comprises 20-60% w/w of hydrophobic monomers. In a most particular embodiment of the present invention the polymer comprises 30-50% w/w of hydrophobic monomers.

In a particular embodiment the polymer composition of the invention is hydrophobically modified polyvinyl pyrrolidone, i.e. a copolymer comprising polymerized monomer units of vinyl pyrrolidone (hereinafter vinyl pyrrolidone groups) and one or more types of hydrophobic polymerized monomer units (hereinafter hydrophobic groups), e.g. polymerized C1-C18-vinylalkanoate such as vinyl acetate. For these polymers it is preferred that they contain between 50 and 95% w/w vinyl pyrrolidone (VP) (and thus 5 to 50% w/w hydrophobic groups, e.g. polymerized C1-C18-vinylalkanoate such as vinylacetate), more preferred between 50 and 80% VP, even more preferred between 50 and 70% VP (and thus 20 to 50% w/w, even more preferred 30 to 50% w/w hydrophobic groups, e.g. a C1-C18-vinylalkanoate such as vinylacetate).

The following section include a description of suitable polymers however the choice of polymer is not limited to the following examples.

Ion-sensitive cationic polymers known from U.S. Pat. No. 7,070,854 may be suitable.

The ion-sensitive cationic polymers of the present invention may be formed from two, three or four different monomers. The copolymers of the present invention are the polymerization product of a cationic monomer and at least one hydrophobic monomer. The terpolymers or tetrapolymers are the polymerization products of a cationic monomer, at least one hydrophobic monomer and optionally at least one hydrophilic monomer or water-soluble nonionic monomer.

The preferred cationic polymer in the ion-sensitive cationic polymers of the present invention is [2-(methacryloyloxy)ethyl]trimethyl ammonium chloride.

A preferred quaternary polymer of the present invention is the polymerization product of the following four monomers: acrylamide, butyl acrylate, 2-ethylhexyl acrylate and [2-(methacryloyloxy)ethyl]trimethyl ammonium chloride. A preferred terpolymer of the present invention is formed from three different monomers: butyl acrylate, 2-ethylhexyl acrylate and [2-(methacryloyloxy)ethyl]trimethyl ammonium chloride. A preferred copolymer of the present invention is the polymerization product of [2-(methacryloyloxy)ethyl] trimethyl ammonium chloride and butyl acrylate or 2-ethylhexyl acrylate. An especially preferred terpolymer of the present invention is the polymerization product of [2-(methacryloyloxy)ethyl]trimethyl ammonium chloride and butyl acrylate and 2-ethylhexyl acrylate. Acrylamide, [2-(methacryloyloxy)ethyl]trimethyl ammonium chloride, butyl acrylate and 2-ethylhexyl acrylate are all commercially available from Aldrich Chemical, Milwaukee, Wis.

For the ion-sensitive quaternary polymer made from acrylamide, butyl acrylate, 2-ethylhexyl acrylate and [2-(methacryloyloxy)ethyl]trimethyl ammonium chloride, the mole percent of monomer in the quaternary polymer is as follows: about 35 to less than 80 mole percent acrylamide; greater than 0 to about 45 mole percent butyl acrylate; greater than 0 to about 65 mole percent 2-ethylhexyl acrylate; and greater than 0 to about 20 mole percent [2-(methacryloyloxy)ethyl]trimethyl ammonium chloride. More specifically, the mole percent of monomers in the quaternary polymer is from about 50 to about 67 mole percent acrylamide; from about 15 to about 28 mole percent butyl acrylate; from about 7 to about 15 mole percent 2-ethylhexyl acrylate; and from greater than 0 to about 10 mole percent [2-(methacryloyloxy)ethyl]trimethyl ammonium chloride. Most specifically, the mole percent of monomers in the quaternary polymer is from about 57 to about 66 mole percent acrylamide; from about 15 to about 28 mole percent butyl acrylate; from about 7 to about 13 mole percent 2-ethylhexyl acrylate; and about 1 to about 6 mole percent [2-(methacryloyloxy)ethyl]trimethyl ammonium chloride.

For the ion-sensitive co- and terpolymer made from butyl acrylate, 2-ethylhexyl acrylate and [2-(methacryloyloxy) ethyl]trimethyl ammonium chloride, the mole percent of monomer in the terpolymer is as follows: from 0 to about 90 mole percent butyl acrylate; from 0 to about 75 mole percent 2-ethylhexyl acrylate; and from 5 to about 60 mole percent [2-(methacryloyloxy)ethyl] trimethyl ammonium chloride.

Other ion-sensitive cationic polymers of the present invention comprise 1) a cationic monomer, 2) at least one water insoluble, hydrophobic monomer, and optionally, 3) a hydrophilic and/or water-soluble nonionic monomer.

The cationic monomers useful in the present invention include quaternary ammonium monomers, including, but not limited to, cationic monomer is selected from [2-(methacryloyloxy)ethyl] trimethyl ammonium chloride, (3-acrylamidopropyl) trimethylammonium chloride, N,N-diallyldimethylammonium chloride, acryloxyethyltrimethyl ammonium chloride, acryloxyethyldimethylbenzyl ammonium chloride, methacryloxyethyldimethyl ammonium chloride, methacryloxyethyltrimethylbenzyl ammonium chloride and quaternized vinyl pyridine. Other vinyl functional monomers which when copolymerized with a water insoluble hydrophobic monomer form ionomers in the presence of divalent metal complex anions are also useful in the present invention.

For the ion-sensitive copolymer made from a cationic monomer and a water insoluble, hydrophobic monomer, the mole percent of monomer in the copolymer is as follows: about 10 to less than 50 mole percent cationic monomer; and greater than 50 to about 90 mole percent water insoluble, hydrophobic monomer. More specifically, the mole percent of monomers in the copolymer is from about 15 to about 25 mole percent cationic monomer; and from about 70 to about 85 mole percent water insoluble, hydrophobic monomer. Most specifically, the mole percent of monomers in the copolymer is from about 20 mole percent cationic monomer; and about 80 mole percent water insoluble, hydrophobic monomer.

For the ion-sensitive terpolymer made from a cationic polymer, a water insoluble hydrophobic monomer and a water soluble or hydrophilic monomer, the mole percent of monomer in the terpolymer is as follows: about 5 to less than 50 mole percent cationic monomer; from about 30 to about 90 mole percent water insoluble hydrophobic monomer; and from about 10 to about 60 mole percent water soluble or hydrophilic monomer.

Phosphorylated polymers containing phosphonic groups, thiosulphonic groups, or other organophosphorous groups may be used as the ion-sensitive polymer in the present invention. This can include modified cellulose or cellulose derivatives and related gums, made insoluble by the presence of monovalent salts or other electrolytes. In one embodiment, soluble cellulose derivatives, such as CMC, are phosphorylated and rendered insoluble and can be effective as ion-sensitive polymer formulations when in a solution of high ionic strength or of appropriate pH, but are dispersible in tap water. In another embodiment, aminophosphinic groups which can be anionic or amphoteric, are added to a polymer. Aminophosphinic groups can be added via condensation of a hypophosphite salt with a primary amine. Reaction of chloromethylphosphinic acid with amines can also yield useful anionic groups, as described by Guenther W. Wasow in "Phosphorous-Containing Anionic Surfactants," Anionic Surfactants: Organic Chemistry, ed. Helmut W. Stache, New York: Marcel Dekker, 1996, pp. 589-590. The entire chapter by Wasow, comprising pages 551-629 of the aforementioned book, offers additional teachings relevant to creating polymers with useful phosphorous groups, and is herein incorporated by reference.

Natural polymers that are already provided with useful anionic groups also can be useful in the present invention. Such polymers include agar and carageenan, which have multiple ester sulfate groups. These may be further modified, if necessary, to have additional anionic groups (e.g., sulfonation, phosphorylation, and the like).

Polymers having two or more differing anionic groups, such as both sulfonic and phosphonic groups, wherein the relative amounts of the differing anions can be adjusted to optimize the strength, the ionic sensitivity, and the dispersibility of the polymer, are also useful in the present invention. This also includes zwitterionic and amphoteric compounds. Polyampholytes in particular can be readily soluble above or below the isoelectric point, but insoluble at the isoelectric point, offering the potential for a triggering mechanism based on electrolyte concentration and pH. Examples of polyampholytes include, but are not limited to, copolymers of methacrylic acid and allylamine, copolymers of methacrylic acid and 2-vinylpyridine, polysiloxane ionomers with pendant amphoteric groups, and polymers formed directly from zwitterionic monomeric salts, such as the ion-pair of co-monomers (IPC) of Salamone et al., all as disclosed by Irja Piirma in Polymeric Surfactants, New York: Marcel Dekker, Inc., 1992, at pp. 251-254, incorporated herein by reference.

In a particular embodiment of the invention the polymer is selected so it is not sensitive to normal water hardness found around the world, i.e. the polymer is soluble not only in pure water, but also is soluble in water with a water hardness up to at least 60° dH or more typically up to at least 30° dH (see e.g. K. Höll; Wasser [Water], 7th Edition (1986), Walter de Gruyter, Berlin).

In a particular embodiment of the invention the polymer is selected so the solubility is especially sensitive to the presence of a specific ion. This can be used to avoid premature release in e.g. a detergent by addition of this specific ion. The solubility of kappa-carrageenan or modified kappa-carrageenan is e.g. more sensitive towards potassium ions than sodium ions.

The compositions according to the invention can additionally contain any excipient conventionally used in the pharmaceutical and enzyme fields which is compatible with the active ingredient.

Enzymes

The enzyme in the context of the present invention may be any enzyme or combination of different enzymes. Accordingly, when reference is made to "an enzyme" this will in general be understood to include one enzyme or a combination of enzymes.

According to the invention the liquid composition contains at least one enzyme. The enzyme may be any commercially available enzyme, in particular an enzyme selected from the group consisting of proteases, amylases, lipases, cellulases, lyases, oxidoreductases and any mixture thereof. Mixtures of enzymes from the same class (e.g. proteases) are also included.

According to the invention a liquid composition comprising a protease is preferred. In a particular embodiment a liquid composition comprising two or more enzymes in which the first enzyme is a protease and the second enzyme is selected from the group consisting of amylases, lipases, cellulases, lyases and oxidoreductases is preferred. In a more particular embodiment the second enzyme is a lipase.

It is to be understood that enzyme variants (produced, for example, by recombinant techniques) are included within the meaning of the term "enzyme". Examples of such enzyme variants are disclosed, e.g. in EP 251,446 (Genencor), WO 91/00345 (Novo Nordisk), EP 525,610 (Solvay) and WO 94/02618 (Gist-Brocades NV).

Enzymes can be classified on the basis of the handbook Enzyme Nomenclature from NCIUBMB, 1992), see also the ENZYME site at the internet: http://www.expasy.ch/enzyme/. ENZYME is a repository of information relative to the nomenclature of enzymes. It is primarily based on the recommendations of the Nomenclature Committee of the International Union of Biochemistry and Molecular Biology (IUB-MB), Academic Press, Inc., 1992, and it describes each type of characterized enzyme for which an EC (Enzyme Commission) number has been provided (Bairoch A. The ENZYME database, 2000, Nucleic Acids Res 28:304-305). This IUB-MB Enzyme nomenclature is based on their substrate specificity and occasionally on their molecular mechanism; such a classification does not reflect the structural features of these enzymes.

Another classification of certain glycoside hydrolase enzymes, such as endoglucanase, xylanase, galactanase, mannanase, dextranase and alpha-galactosidase, in families based on amino acid sequence similarities has been proposed a few years ago. They currently fall into 90 different families: See the CAZy(ModO) internet site (Coutinho, P. M. & Henrissat, B. (1999) Carbohydrate-Active Enzymes server at URL: http://afmb.cnrs-mrs.fr/~cazy/CAZY/index.html (corresponding papers: Coutinho, P. M. & Henrissat, B. (1999) Carbohydrate-active enzymes: an integrated database approach. In "Recent Advances in Carbohydrate Bioengineering", H. J. Gilbert, G. Davies, B. Henrissat and B. Svensson eds., The Royal Society of Chemistry, Cambridge, pp. 3-12; Coutinho, P. M. & Henrissat, B. (1999) The modular structure of cellulases and other carbohydrate-active enzymes: an integrated database approach. In "Genetics, Biochemistry and Ecology of Cellulose Degradation"., K. Ohmiya, K. Hayashi, K. Sakka, Y. Kobayashi, S. Karita and T. Kimura eds., Uni Publishers Co., Tokyo, pp. 15-23).

The types of enzymes which may be incorporated in particles of the invention include oxidoreductases (EC 1.-.-.-), transferases (EC 2.-.-.-), hydrolases (EC 3.-.-.-), lyases (EC 4.-.-.-), isomerases (EC 5.-.-.-) and ligases (EC 6.-.-.-).

The particle may comprise a protease, such as a serine protease.

Proteases: Suitable proteases include those of animal, vegetable or microbial origin. Microbial origin is preferred. Chemically or genetically modified mutants are included. The protease may be a serine protease, preferably an alkaline microbial protease or a trypsin-like protease. Examples of alkaline proteases are subtilisins, especially those derived from *Bacillus*, e.g., subtilisin Novo, subtilisin Carlsberg, subtilisin 309, subtilisin 147 and subtilisin 168 (described in WO 89/06279). Examples of trypsin-like proteases are trypsin (e.g. of porcine or bovine origin) and the *Fusarium* protease described in WO 89/06270. In a particular embodiment of the present invention the protease is a serine protease. Serine proteases or serine endopeptidases (newer name) are a class of peptidases which are characterised by the presence of a serine residue in the active center of the enzyme.

Serine proteases: A serine protease is an enzyme which catalyzes the hydrolysis of peptide bonds, and in which there is an essential serine residue at the active site (White, Handler and Smith, 1973 "Principles of Biochemistry," Fifth Edition, McGraw-Hill Book Company, NY, pp. 271-272).

The bacterial serine proteases have molecular weights in the 20,000 to 45,000 Daltons range. They are inhibited by diisopropylfluorophosphate. They hydrolyze simple terminal esters and are similar in activity to eukaryotic chymotrypsin, also a serine protease. A more narrow term, alkaline protease, covering a sub group, reflects the high pH optimum of some of the serine proteases, from pH 9.0 to 11.0 (for review, see Priest (1977) Bacteriological Rev. 41 711-753). Subtilases: A sub-group of the serine proteases tentatively designated subtilases has been proposed by Siezen et al. (1991), Protein Eng., 4 719-737. They are defined by homology analysis of more than 40 amino acid sequences of serine proteases previously referred to as subtilisin-like proteases. A subtilisin was previously defined as a serine protease produced by Gram-positive bacteria or fungi, and according to Siezen et al. now is a subgroup of the subtilases. A wide variety of subtilisins have been identified, and the amino acid sequence of a number of subtilisins have been determined. These include more than six subtilisins from *Bacillus* strains, namely, subtilisin 168, subtilisin BPN', subtilisin Carlsberg, subtilisin Y, subtilisin amylosacchariticus, and mesentericopeptidase (Kurihara et al. (1972) J. Biol. Chem. 247 5629-5631; Wells et al. (1983) Nucleic Acids Res. 11 7911-7925; Stahl and Ferrari (1984) J. Bacteriol. 159 811-819, Jacobs et al. (1985) Nucl. Acids Res. 13 8913-8926; Nedkov et al. (1985) Biol. Chem. Hoppe-Seyler 366 421-430, Svendsen et al. (1986) FEBS Lett. 196 228-232), one subtilisin from an actinomycetales, thermitase from *Thermoactinomyces vulgaris* (Meloun et al. (1985) FEBS Lett. 198 195-200), and one fungal subtilisin, proteinase K from *Tritirachium album* (Jany and Mayer (1985) Biol. Chem. Hoppe-Seyler 366 584-492). for further reference Table I from Siezen et al. has been reproduced below.

Subtilisins are well-characterized physically and chemically. In addition to knowledge of the primary structure (amino acid sequence) of these enzymes, over 50 high resolution X-ray structures of subtilisins have been determined which delineate the binding of substrate, transition state, products, at least three different protease inhibitors, and define the structural consequences for natural variation (Kraut (1977) Ann. Rev. Biochem. 46 331-358).

One subgroup of the subtilases, I-S1, comprises the "classical" subtilisins, such as subtilisin 168, subtilisin BPN', subtilisin Carlsberg (ALCALASE®, Novozymes A/S), and subtilisin DY.

A further subgroup of the subtilases 1-S2, is recognised by Siezen et al. (supra). Sub-group I-S2 proteases are described as highly alkaline subtilisins and comprise enzymes such as subtilisin PB92 (MAXACAL®, Gist-Brocades NV), subtilisin 309 (SAVINASE®, Novozymes A/S), subtilisin 147 (ESPERASE®, Novozymes A/S), and alkaline elastase YaB.

Random and site-directed mutations of the subtilase gene have both arisen from knowledge of the physical and chemical properties of the enzyme and contributed information relating to subtilase's catalytic activity, substrate specificity, tertiary structure, etc. (Wells et al. (1987) Proc. Natl. Acad. Sci. U.S.A. 84; 1219-1223; Wells et al. (1986) Phil. Trans. R. Soc. Lond. A. 317 415-423; Hwang and Warshel (1987) Biochem. 26 2669-2673; Rao et al., (1987) Nature 328 551-554.

More recent publications covering this area are Carter et al. (1989) Proteins 6 240-248 relating to design of variants that cleave a specific target sequence in a substrate (positions 24 and 64); Graycar et al. (1992) Annals of the New York Academy of Sciences 672 71-79 discussing a number of previously published results; and Takagi (1993) Int. J. Biochem. 25 307-312 also reviewing previous results.

Examples of commercially available proteases (peptidases) include Kannase™, Everlase™ Esperase™, Alcalase™, Neutrase™, Durazym™, Savinase™, Ovozyme™, Pyrase™ Pancreatic Trypsin NOVO (PTN), Bio-Feed™ Pro and Clear-Lens™ Pro (all available from Novozymes A/S, Bagsvaerd, Denmark). Other preferred proteases include those described in WO 01/58275 and WO 01/58276.

Other commercially available proteases include Ronozyme™ Pro, Maxatase™, Maxacal™ Maxapem™, Opticlean™, Propease™, Purafect™ and Purafect Ox™ (available from Genencor International Inc., Gist-Brocades, BASF, or DSM Nutritional Products).

Examples of commercially available lipases include Lipex™, Lipoprime™, Lipopan™ Lipolase™, Lipolase™ Ultra, Lipozyme™, Palatase™, Resinase™, Novozym™ 435 and Lecitase™ (all available from Novozymes A/S).

Lipases: Suitable lipases include those of bacterial or fungal origin. Chemically or genetically modified mutants are included.

Examples of useful lipases include a *Humicola lanuginosa* lipase, e.g., as described in EP 258 068 and EP 305 216, a *Rhizomucor miehei* lipase, e.g., as described in EP 238 023, a *Candida* lipase, such as a *C. antarctica* lipase, e.g., the *C. antarctica* lipase A or B described in EP 214 761, a *Pseudomonas* lipase such as a *P. pseudoalcaligenes* and *P. alcali*-genes lipase, e.g., as described in EP 218 272, a *P. cepacia* lipase, e.g., as described in EP 331 376, a *P. stutzeri* lipase, e.g., as disclosed in BP 1,372,034, a *P. fluorescens* lipase, a *Bacillus lipase*, e.g., a *B. subtilis* lipase (Dar-tois et al., (1993), Biochemica et Biophysica acta 1131, 253-260), a *B. stearothermophilus* lipase (JP 64/744992) and a *B. pumilus* lipase (WO 91/16422).

Furthermore, a number of cloned lipases may be useful, including the *Penicillium camenbertii* lipase described by Ya-maguchi et al., (1991), Gene 103, 61-67), the *Geotricum candidum* lipase (Schimada, Y. et al., (1989), J. Biochem. 106, 383-388), and various *Rhizopus* lipases such as a *R. delemar* lipase (Hass, M. J et al., (1991), Gene 109, 117-113), a *R. niveus* lipase (Kugimiya et al., (1992), Biosci. Biotech. Bio-chem. 56, 716-719) and a *R. oryzae* lipase.

Other types of lipolytic enzymes such as cutinases may also be useful, e.g., a cutinase derived from *Pseudomonas mendocina* as described in WO 88/09367, or a cutinase derived from *Fusarium solani* pisi (e.g. described in WO 90/09446).

Examples of commercially available lipases include Lipex™, Lipoprime™, Lipopan™ Lipolase™, Lipolase™ Ultra, Lipozyme™, Palatase™, Resinase™, Novozym™ 435 and Lecitase™ (all available from Novozymes A/S).

Other commercially available lipases include Lumafast™ (*Pseudomonas* mendocina lipase from Genencor International Inc.); Lipomax™ (*Ps. pseudoalcaligenes* lipase from GistBrocades/Genencor Int. Inc.; and *Bacillus* sp. lipase from Solvay enzymes. Further lipases are available from other suppliers such as Lipase P "Amano" (Amano Pharmaceutical Co. Ltd.).

Amylases: Suitable amylases (α and/or β) or include those of bacterial or fungal origin.

Chemically or genetically modified mutants are included. Amylases include, for example, a-amylases obtained from a special strain of *B. licheniformis*, described in more detail in British Patent Specification No. 1,296,839. Commercially available amylases are Duramyl™ Termamyl™, Fungamyl™ and BAN™ (available from Novozymes A/S) and Rapidase™ and Maxamyl P™ (available from Gist-Brocades).

Cellulases: Suitable cellulases include those of bacterial or fungal origin. Chemically or genetically modified mutants are included. Suitable cellulases are disclosed in U.S. Pat. No. 4,435,307, which discloses fungal cellulases produced from *Humicola insolens*. Especially suitable cellulases are the cellulases having color care benefits. Examples of such cellulases are cellulases described in European patent application No. 0 495 257.

Oxidoreductases: Any oxidoreductase suitable for use in a liquid composition, e.g., peroxidases or oxidases such as laccases, can be used herein. Suitable peroxidases herein include those of plant, bacterial or fungal origin. Chemically or genetically modified mutants are included. Examples of suitable peroxidases are those derived from a strain of *Coprinus*, e.g., *C. cinerius* or *C. macrorhizus*, or from a strain of *Bacillus*, e.g., *B. pumilus*, particularly peroxidase according to WO 91/05858. Suitable laccases herein include those of bacterial or fungal origin. Chemically or genetically modified mutants are included. Examples of suitable laccases are those obtainable from a strain of *Trametes*, e.g., *T. villosa* or *T. versicolor*, or from a strain of *Coprinus*, e.g., *C. cinereus*, or from a strain of *Myceliophthora*, e.g., *M. thermophila*.

The types of enzymes which may be present in the liquid of the invention include oxidoreductases (EC 1.-.-.-), transferases (EC 2.-.-.-), hydrolases (EC 3.-.-.-), lyases (EC 4.-.-.-), isomerases (EC 5.-.-.-) and ligases (EC 6.-.-.-).

Preferred oxidoreductases in the context of the invention are peroxidases (EC 1.11.1), laccases (EC 1.10.3.2) and glucose oxidases (EC 1.1.3.4)]. An Example of a commercially available oxidoreductase (EC 1.-.-.-) is Gluzyme™ (enzyme available from Novozymes A/S).

Further oxidoreductases are available from other suppliers. Preferred transferases are transferases in any of the following sub-classes:

a Transferases transferring one-carbon groups (EC 2.1);

b transferases transferring aldehyde or ketone residues (EC 2.2); acyltransferases (EC 2.3);

c glycosyltransferases (EC 2.4);

d transferases transferring alkyl or aryl groups, other that methyl groups (EC 2.5); and e transferases transferring nitrogeneous groups (EC 2.6).

A most preferred type of transferase in the context of the invention is a transglutaminase (protein-glutamine γ-glutamyltransferase; EC 2.3.2.13).

Further examples of suitable transglutaminases are described in WO 96/06931 (Novo Nordisk A/S).

Preferred hydrolases in the context of the invention are: carboxylic ester hydrolases (EC 3.1.1.-) such as lipases (EC 3.1.1.3); phytases (EC 3.1.3.-), e.g. 3-phytases (EC 3.1.3.8) and 6-phytases (EC 3.1.3.26); glycosidases (EC 3.2, which fall within a group denoted herein as "carbohydrases"), such as α-amylases (EC 3.2.1.1); peptidases (EC 3.4, also known as proteases); and other carbonyl hydrolases. Examples of commercially available phytases include Bio-Feed™ Phytase (Novozymes), Ronozyme™ P (DSM Nutritional Products), Natuphos™ (BASF), Finase™ (AB Enzymes), and the Phyzyme™ product series (Danisco). Other preferred phytases include those described in WO 98/28408, WO 00/43503, and WO 03/066847.

In the present context, the term "carbohydrase" is used to denote not only enzymes capable of breaking down carbohydrate chains (e.g. starches or cellulose) of especially five- and six-membered ring structures (i.e. glycosidases, EC 3.2), but also enzymes capable of isomerizing carbohydrates, e.g. six-membered ring structures such as D-glucose to five-membered ring structures such as D-fructose.

Carbohydrases of relevance include the following (EC numbers in parentheses): α-amylases (EC 3.2.1.1), β-amylases (EC 3.2.1.2), glucan 1,4-α-glucosidases (EC 3.2.1.3), endo-1,4-beta-glucanase (cellulases, EC 3.2.1.4), endo-1,3(4)-β-glucanases (EC 3.2.1.6), endo-1,4-β-xylanases (EC 3.2.1.8), dextranases (EC 3.2.1.11), chitinases (EC 3.2.1.14), polygalacturonases (EC 3.2.1.15), lysozymes (EC 3.2.1.17), β-glucosidases (EC 3.2.1.21), α-galactosidases (EC 3.2.1.22), β-galactosidases (EC 3.2.1.23), amylo-1,6-glucosidases (EC 3.2.1.33), xylan 1,4-β-xylosidases (EC 3.2.1.37), glucan endo-1,3-β-D-glucosidases (EC 3.2.1.39), α-dextrin endo-1,6-α-glucosidases (EC3.2.1.41), sucrose α-glucosidases (EC 3.2.1.48), glucan endo-1,3-α-glucosidases (EC 3.2.1.59), glucan 1,4-β-glucosidases (EC 3.2.1.74), glucan endo-1,6-β-glucosidases (EC 3.2.1.75), galactanases (EC 3.2.1.89), arabinan endo-1,5-α-L-arabinosidases (EC 3.2.1.99), lactases (EC 3.2.1.108), chitosanases (EC 3.2.1.132) and xylose isomerases (EC 5.3.1.5).

Examples of commercially available carbohydrases include Alpha-Gal™, Bio-Feed™ Alpha, Bio-Feed™ Beta, Bio-Feed™ Plus, Bio-Feed™ Wheat, Bio-Feed™ Z, Novozyme™ 188, Carezyme™, Celluclast™, Cellusoft™, Celluzyme™, Ceremyl™, Citrozym™, Denimax™ Dezyme™, Dextrozyme™, Duramyl™, Energex™, Finizym™, Fungamyl™, Gamanase™ Glucanex™, Lactozym™, Liquezyme™, Maltogenase™, Natalase™, Pentopan™, Pectinex™ Promozyme™, Pulpzyme™, Novamyl™, Termamyl™, AMG™ (Amyloglucosidase Novo), Maltogenase™, Sweetzyme™ and Aquazym™ (all available from Novozymes A/S). Further carbohydrases are available from other suppliers, such as the Roxazyme™ and Ronozyme™ product series (DSM Nutritional Products), the Avizyme™, Porzyme™ and Grindazyme™ product series (Danisco, Finnfeeds), and Natugrain™ (BASF), Purastar™ and Purastar™ OxAm (Genencor).

Other commercially available enzymes include Mannaway™, Pectaway™, Stainzyme™ and Renozyme™.

Additional Materials

Additional materials to be incorporated in the particle can be polysaccharides, waxes, enzyme activators or enhancing agents, fillers, enzyme stabilizing agents, solubilising agents, crosslinking agents, suspension agents, viscosity regulating agents, light spheres, chlorine scavengers, plasticizers, pigments, salts, preservatives and fragrances.

Polysaccharides:

The polysaccharides of the present invention may be un-modified naturally occurring polysaccharides or modified naturally occurring polysaccharides.

Suitable polysaccharides include cellulose, pectin, dextrin and starch. The starches may be soluble or insoluble in water.

In a particular embodiment of the present invention the polysaccharide is a starch. In a particular embodiment of the present invention the polysaccharide is an insoluble starch.

Naturally occurring starches from a wide variety of plant sources are suitable in the context of the invention (either as starches per se, or as the starting point for modified starches), and relevant starches include starch from: rice, corn, wheat, potato, oat, cassava, sago-palm, yuca, barley, sweet potato, sorghum, yams, rye, millet, buckwheat, arrowroot, taro, tannia, and may for example be in the form of flour.

Cassava starch is among preferred starches in the context of the invention; in this connection it may be mentioned that cassava and cassava starch are known under various synonyms, including tapioca, manioc, mandioca and manihot.

As employed in the context of the present invention, the term "modified starch" denotes a naturally occurring starch, which has undergone some kind of at least partial chemical modification, enzymatic modification, and/or physical or physicochemical modification, and which—in general—exhibits altered properties relative to the "parent" starch.

Waxes:

A "wax" in the context of the present invention is to be understood as a polymeric material having a melting point between 25-150° C., particularly 30 to 100° C. more particularly 35 to 85° C. most particularly 40 to 75° C. The wax is preferably in a solid state at room temperature, 25° C. The lower limit is preferred to set a reasonable distance between the temperature at which the wax starts to melt to the temperature at which the particles or compositions comprising the particles are usually stored, 20 to 30° C.

For some particles, e.g. particles used in the detergent industry, a preferable feature of the wax is that the wax should be water soluble or water dispersible, particularly in neutral and alkaline solution, so that when the coated particles of the invention is introduced into an aqueous solution, i.e. by diluting it with water, the wax should disintegrate and/or dissolve providing a quick release and dissolution of the active incorporated in the particles to the aqueous solution. Examples of water soluble waxes are poly ethylene glycols (PEG's). Amongst water insoluble waxes, which are dispersible in an aqueous solution are triglycerides and oils. For some particles it is preferable that the coating contains some insoluble waxes e.g. feed particles.

The wax composition of the invention may comprise any wax, which is chemically synthesized. It may also equally well comprise waxes isolated from a natural source or a derivative thereof. Accordingly, the wax composition of the invention may comprise waxes selected from the following non limiting list of waxes.

- Poly ethylene glycols, PEG. Different PEG waxes are commercially available having different molecular sizes, wherein PEG's with low molecular sizes also have low melting points. Examples of suitable PEG's are PEG 1500, PEG 2000, PEG 3000, PEG 4000, PEG 6000, PEG 8000, PEG 9000 etc. e.g. from BASF (Pluriol E series) or from Clariant or from Ineos. Derivatives of Poly ethylene glycols may also be used.
- polypropylens (e.g. polypropylen glycol Pluriol P series from BASF) or polyethylens or mixtures thereof. Derivatives of polypropylenes and polyethylenes may also be used.
- Nonionic surfactants which are solid at room temperature such as ethoxylated fatty alcohols having a high level of ethoxy groups such as the Lutensol AT series from BASF, a C16-C18 fatty alcohol having different amounts of ethyleneoxide per molecule, e.g. Lutensol AT11, AT13, AT25, AT50, AT80, where the number indicate the average number of ethyleneoxide groups. Alternatively polymers of ethyleneoxide, propyleneoxide or copolymers thereof are useful, such as in block polymers, e.g. Pluronic PE 6800 from BASF. Derivatives of ethoxylated fatty alcohols.
- Waxes isolated from a natural source, such as Carnauba wax (melting point between 80-88° C.), Candelilla wax (melting point between 68-70° C.) and bees wax. Other natural waxes or derivatives thereof are waxes derived from animals or plants, e.g. of marine origin. Hydrogenated plant oil or animal tallow. Examples of such waxes are hydrogenated ox tallow, hydrogenated palm oil, hydrogenated cotton seeds and/or hydrogenated soy bean oil, wherein the term "hydrogenated" as used herein is to be construed as saturation of unsaturated carbohydrate chains, e.g. in triglycerides, wherein carbon=carbon double bonds are converted to carbon-carbon single bonds. Hydrogenated palm oil is commercially available e.g. from Hobum Oele and Fette GmbH-Germany or Deutche Cargill GmbH—Germany.
- Fatty acid alcohols, such as the linear long chain fatty acid alcohol NAFOL 1822 (C18, 20, 22) from Condea Chemie GMBH-Germany, having a melting point between 55-60° C. Derivatives of fatty acid alcohols.
- Mono-glycerides and/or di-glycerides, such as glyceryl stearate, wherein stearate is a mixture of stearic and palmitic acid, are useful waxes. An example of this is Dimodan PM—from Danisco Ingredients, Denmark.
- Fatty acids, such as hydrogenated linear long chained fatty acids and derivatives of fatty acids.
- Paraffines, i.e. solid hydrocarbons.
- Micro-crystalline wax.

In further embodiments waxes which are useful in the invention can be found in C. M. McTaggart et. al., Int. J. Pharm. 19, 139 (1984) or Flanders et. al., Drug Dev. Ind. Pharm. 13, 1001 (1987) both incorporated herein by reference.

In a particular embodiment of the present invention the wax of the present invention is a mixture of two or more different waxes.

In a particular embodiment of the present invention the wax or waxes is selected from the group consisting of PEG, ethoxylated fatty alcohols, fatty acids, fatty acid alcohols and glycerides.

In another particular embodiment of the present invention the waxes are chosen from synthetic waxes. In a more particular embodiment the waxes of the present invention are PEG or non-ionic surfactants. In a most particular embodiment of the present invention the wax is PEG.

Fillers:

Suitable fillers are water soluble and/or insoluble inorganic salts such as finely ground alkali sulphate, alkali carbonate and/or alkali chloride, clays such as kaolin (e.g. SPESWHITE™, English China Clay), bentonites, talcs, zeolites, chalk, calcium carbonate and/or silicates.

Typical fillers are di-sodium sulphate and calcium-lignosulphonate. Other fillers are silica, gypsum, kaolin, talc, magnesium aluminium silicate and cellulose fibres.

Enzyme stabilizing or enzyme protecting agents:

Enzyme stabilizing or -protective agents may fall into several categories: alkaline or neutral materials, reducing agents, antioxidants and/or salts of first transition series metal ions. Each of these may be used in conjunction with other protective agents of the same or different categories. Examples of alkaline protective agents are alkali metal silicates, -carbonates or bicarbonates which provide a chemical scavenging effect by actively neutralizing e.g. oxidants. Examples of reducing protective agents are salts of sulfite, thiosulfite or thiosulfate, while examples of antioxidants are methionine, butylated hydroxytoluene (BHT) or butylated hydroxyanisol (BHA). Most preferred agents are salts of thiosulfates, e.g. sodium thiosulfate. Also enzyme stabilizers may be borates, borax, formates, di- and tricarboxylic acids and so called reversible enzyme inhibitors such as organic compounds with sulfhydryl groups or alkylated or arylated boric acids.

Cross Linking Agents:

Cross-linking agents such as enzyme-compatible surfactants, e.g. ethoxylated alcohols, especially ones with 10 to 80 ethoxy groups.

Solubilising Agents:

The solubility of the particle is especially critical in cases where the coated particle is a component of a detergent formulation. As is known by the person skilled in the art, many agents, through a variety of methods, serve to increase the solubility of formulations, and typical agents known to the art can be found in National Pharmacopeia's.

Light Spheres:

Light spheres are small particles with low true density. Typically, they are hollow spherical particles with air or gas inside. Such materials are usually prepared by expanding a solid material. These light spheres may be inorganic of nature or organic of nature, such as the PM-series (plastic hollow spheres) available from The PQ Corporation. Light spheres can also be prepared from polysaccharides, such as starch or derivatives thereof. Biodac® is an example of non-hollow lightweight material made from cellulose (waste from papermaking), available from GranTek Inc. These materials may be included in the particles of the invention either alone or as a mixture of different light materials.

Suspension Agents:

Suspension agents, mediators (for boosting bleach action upon dissolution of the particle in e.g. a washing application) and/or solvents may be incorporated in the particle.

Viscosity Regulating Agents:

Viscosity regulating agents may be present in the particle.

Plasticizers:

Plasticizers useful in particles in the context of the present invention include, for example: polyols such as sugars, sugar alcohols, glycerine, glycerol trimethylol propane, neopentyl glycol, triethanolamine, mono-, di- and triethylene glycol or polyethylene glycols (PEGs) having a molecular weight less than 1000; urea, phthalate esters such as dibutyl or dimethyl phthalate; thiocyanates, non-ionic surfactants such as ethoxylated alcohols and ethoxylated phosphates and water.

Pigments:

Suitable pigments include, but are not limited to, finely divided whiteners, such as titanium dioxide or kaolin, coloured pigments, water soluble colorants, as well as combinations of one or more pigments and water soluble colorants.

Salts:

The salt may be an inorganic salt, e.g. salts of sulfate, sulfite, phosphate, phosphonate, nitrate, chloride or carbonate or salts of simple organic acids (less than 10 carbon atoms e.g. 6 or less carbon atoms) such as citrate, malonate or acetate. Examples of cations in these salt are alkali or earth alkali metal ions, although the ammonium ion or metal ions of the first transition series, such as sodium, potassium, magnesium, calcium, zinc or aluminium. Examples of anions include chloride, bromide, iodide, sulfate, sulfite, bisulfite, thiosulfate, phosphate, monobasic phosphate, dibasic phosphate, hypophosphite, dihydrogen pyrophosphate, tetraborate, borate, carbonate, bicarbonate, metasilicate, citrate, malate, maleate, malonate, succinate, lactate, formate, acetate, butyrate, propionate, benzoate, tartrate, ascorbate or gluconate. In particular alkali- or earth alkali metal salts of sulfate, sulfite, phosphate, phosphonate, nitrate, chloride or carbonate or salts of simple organic acids such as citrate, malonate or acetate may be used. Specific examples include $NaH_2PO_4$, $Na_2HPO_4$, $Na_3PO_4$, $(NH_4)H_2PO_4$, $K_2HPO_4$, $KH_2PO_4$, $Na_2SO_4$, $K_2SO_4$, $KHSO_4$, $ZnSO_4$, $MgSO_4$, $CuSO_4$, $Mg(NO_3)_2$, $(NH_4)_2SO_4$, sodium borate, magnesium acetate and sodium citrate.

The salt may also be a hydrated salt, i.e. a crystalline salt hydrate with bound water(s) of crystallization, such as described in WO 99/32595. Examples of hydrated salts include magnesium sulfate heptahydrate ($MgSO_4(7H_2O)$), zinc sulfate heptahydrate ($ZnSO_4(7H_2O)$), copper sulfate pentahydrate ($CuSO_4(5H_2O)$), sodium phosphate dibasic heptahydrate ($Na_2HPO_4(7H_2O)$), magnesium nitrate hexahydrate ($Mg(NO_3)_2(6H_2O)$), sodium borate decahydrate, sodium citrate dihydrate and magnesium acetate tetrahydrate.

Additional Coatings

The particles of the present invention may comprise one, two or more additional coating layers. In a particular embodiment of the present invention the particle comprise at least two coating layers.

Additional coatings may be applied to the particle to provide additional characteristics or properties. Thus, for example, an additional coating may achieve one or more of the following effects:

(i) further protection of the active compound in the particle against hostile compounds in the surroundings.

(ii) dissolution at a desired rate upon introduction of the particle into a liquid medium (such as an acid medium);

(iii) provide a better physical strength of the particle.

In a particular embodiment of the present invention an outer layer may be applied as known within microencapsulation technology, e.g. via polycondensation as interfacial polymerization and in situ polymerization, coacervation, gelation and chelation, solvent extraction, evaporation and suspension crosslinking.

Different coating techniques are described in "Microspheres, Microcapsules and Liposomes", ed. Reza Arshady, Citus Books Ltd. And in WO 97/24179 which is hereby incorporated by reference.

Preparation of Particles

The present invention further provides in a second aspect a method for preparation of an enzyme particle comprising the steps of preparing a solution of the enzyme and the polymer, atomizing this solution in a gas or a liquid to make small droplets (atomizing in a gas correspond to a spray drying process, atomizing in a water immiscible liquid gives an emulsion) and drying these droplets to form solid particles. For emulsions the drying process can be azeotropic distillation as described e.g. in EP 0356239.

The particles may be prepared by but is not limited to technologies known in the art of making nano- and microparticles, e.g. via atomization in air or liquid, ie. a) spray drying or b) emulsion processes or by c) particle size reduction of larger particles e.g. via dry or wet milling.

a) Spray drying process, wherein a liquid enzyme-containing solution is atomized in a spray drying tower to form small droplets which during their way down the drying tower dry to form an enzyme-containing particulate material. Very small particles can be produced this way (Michael S. Showell (editor); Powdered detergents; Surfactant Science Series; 1998; vol. 71; page 140-142; Marcel Dekker).

b) Emulsion process, wherein an aqueous liquid enzyme containing solution is emulsified in a water immiscible liquid e.g. paraffinic oil. To ease the formation of droplets and stabilize the emulsion various emulsifiers and surfactants are used. The water from the droplet can subsequently be removed be distillation, e.g. azeotropic distillation, or by spray drying the emulsion if the water immiscible liquid is volatile.

c) Size reduction process, wherein preformed larger particles/briquettes or the like are reduced in particle size via milling the larger particles. This can be performed on dry particles (dry milling) or using a dispersion of the particles in a liquid, a so-called slurry (wet milling).

The particles of the invention may be prepared by preparing a mixture of the enzyme and the polymer, forming particles and drying. In a particular embodiment of the present invention the particles are prepared by spray drying, an emulsion process and/or a size reduction process.

Compositions Comprising the Particles of the Invention

Liquid Compositions

The liquid composition of the present composition can be any liquid composition which is suitable to comprise the particles of the invention. The liquid composition may be any composition, but particularly suitable compositions are personal care compositions, cleaning compositions, textile processing compositions e.g. bleaching, pharmaceutical compositions, leather processing compositions, fuel, pulp or paper processing compositions, food and beverage compositions and animal feed compositions. In a further particular embodiment of the present invention the liquid composition is a liquid detergent composition. In a more particular embodiment of the present invention the liquid composition is a laundry or a dishwashing detergent composition.

In a particular embodiment of the present invention the liquid composition comprises an electrolyte. In this invention the electrolyte prevents the dissolution of the particles. The latter protect the enzyme until the detergent is introduced into wash liquor, where the electrolyte is diluted sufficiently for the particle to dissolve and release the enzyme, so that it is available to act on stains.

In a particular embodiment of the present invention the liquid composition comprises less than 50% water. In a more particular embodiment the liquid composition comprises less than 30% water. In a further embodiment of the present invention the liquid composition comprises less than 20% water.

If the liquid composition is a liquid detergent composition, the liquid composition may comprise a surfactant desolubilising electrolyte, said electrolyte being present in a concentration at which said surfactant forms a structure capable of stably suspending the enzyme/polymer particles and sufficient to prevent or inhibit dissolution of the water soluble polymer.

The liquid detergent composition comprise in a particular embodiment between 30% to 70% of water by weight of the liquid detergent. In a more particular embodiment the liquid detergent comprise between 40% to 60% of water by weight of liquid detergent. In a most particular embodiment the liquid detergent comprises between 80% to 90% of water by weight of liquid detergent.

In a particular embodiment of the present invention the liquid detergent composition comprises more than 30% water but less than 90%. The amount of water comprised in the liquid detergent composition is particularly less than 85%, more particularly less than 75%, such as less than 60% by weight of the liquid detergent.

Liquid detergent compositions according to the invention are conventional compositions normally used in laundry or dishwashing applications.

In a particular embodiment the composition comprises an effective amount of a detergent builder. Suitable builders include condensed phosphates, especially sodium tripolyphosphate or, less preferably, sodium pyrophosphate or sodium tetraphosphate, sodium metaphosphate, sodium carbonate, sodium silicate, sodium orthophosphate, sodium citrate, sodium nitrilotriacetate, a phosphonate such as sodium ethylenediamine tetrakis (methylene phosphonate), sodium diethylenetriamine pentakis (methylene phosphonate), sodium aceto diphosphonate or sodium aminotris (methylene phosphonate), sodium ethylenediamine tetraacetate or a zeolite. Other less preferred builders include potassium or lithium analogues of the above sodium salts.

The proportion of builder is typically from about 5% to about 40% by weight of the liquid detergent composition. Usually 10% to 35%, preferably 15-30%, more preferably 18 to 28%, most preferably 20 to 27%. Mixtures of two or more builders are often employed, e.g. sodium tripolyphosphate with sodium silicate and/or sodium carbonate and/or with zeolite; or sodium nitrilotriacetate with sodium citrate.

Preferably the builder is at least partly present as solid particles suspended in the composition. The invention is also applicable to the preparation of unbuilt cleaning compositions or compositions in which all the builder is present in solution.

The detergent composition of the invention comprises in a particular embodiment one or more surfactants, which may be non-ionic including semi-polar and/or anionic and/or cationic and/or zwitterionic. Generally, the surfactant will be present in the liquid composition in an amount from about 0.1% to 90% by weight of the composition. In a particular embodiment the surfactant will be present in the liquid composition in an amount from about 10% to 60% by weight of the composition. In another particular embodiment the surfactant will be present in the liquid composition in an amount from about 2 to 35% by weight of the composition.

When included therein the detergent will usually contain from about 1% to about 40% of an anionic surfactant such as linear alkyl benzene sulfonate, alpha-olefin sulfonate, alkyl sulfate (fatty alcohol sulfate), alcohol ethoxysulfate, secondary alkanesulfonate, alpha-sulfo fatty acid methyl ester, alkyl- or alkenylsuccinic acid or soap. Highly preferred anionic surfactants are the linear alkyl benzene sulfonate (LAS) materials. Such surfactants and their preparation are described for example in U.S. Pat. Nos. 2,220,099 and 2,477,383, incorporated herein by reference. Especially preferred are the sodium and potassium linear straight chain alkylbenzene sulfonates, in which the average number of carbon atoms in the alkyl group is from about 11 to 14. Sodium $C_{11}$-$C_{14}$, e.g., $C_{12}$ LAS is especially preferred. Other useful anionic surfactants are described in WO 99/0478, pages 11 through 13, incorporated herein by reference.

When included therein the detergent will usually contain from about 0.2% to about 40% of a non-ionic surfactant such as alcohol ethoxylate, nonylphenol ethoxylate, alkylpolyglycoside, alkyldimethylamineoxide, ethoxylated fatty acid monoethanolamide, fatty acid monoethanolamide, polyhydroxy alkyl fatty acid amide, or N-acyl N-alkyl derivatives of glucosamine ("glucamides"). Such useful non-ionic surfactants are further described in WO 99/0478, pages 13 through 14, incorporated herein by reference.

The detergent may also contain ampholytic and/or zwitterionic surfactants.

A typical listing of anionic, non-ionic, ampholytic and zwitterionic surfactants is given in U.S. Pat. No. 3,664,961 issued to Norris on May 23, 1972.

In general any surfactant referred to in GB 1,123,846, or in "Surface Active Agents and Detergents" by Schwartz, Perry and Berch, may be used.

Preferably the pH of the liquid detergent composition is alkaline, e.g. above 7.5, especially 7.5 to 12 typically 8 to 11, e.g. 9 to 10.5.

The liquid detergent composition comprise in a particular embodiment dissolved, surfactant-desolubilising electrolyte. Examples include sodium chloride, sodium nitrate, sodium bromide, sodium iodide, sodium fluoride, sodium borate, sodium formate, or sodium acetate, or corresponding potassium salts. In particularly, however, the electrolyte is a salt which is required to perform a useful function in the wash liquor.

In a particular embodiment the concentrations of electrolyte in solution is greater than 3%, such as greater than 5% by weight. In a another embodiment the concentrations of electrolyte in solution are 6 to 20%, especially 7 to 19%, such as 8 to 18%, 9 to 17%, 10 to 16%, e.g. 11 to 15% by weight of electrolyte in solution, based on the weight of the composition. The electrolyte content is preferably adjusted to provide at least three months storage stability at ambient, at 0° C. and at 40° C.

The detergent composition may contain any of the usual minor ingredients such as soil suspending agents (e.g. carboxymethyl cellulose), preservatives such as formaldehyde or tetrakis (hydroxymethyl) phosphonium salts, bentonite clays, or any of the enzymes described herein, protected according to the invention. Where a bleach is to be employed it may be convenient to encapsulate the bleach e.g. with a hydrophilic encapsulant, or in a hydrophobic medium, such as, for instance a silicone or hydrocarbon as described in EP-A-0238216 or GB-A-2200377.

The liquid detergent compositions according to the present invention may also contain 0-65% w/w of chelating agents. Such chelating agents may be selected from the group consisting of amino carboxylates, amino phosphonates, polyfunctionally-substituted aromatic chelating agents, diphosphate, triphosphate, carbonate, citrate, nitrilotriacetic acid, ethylenediaminetetraacetic acid, diethylenetriaminepentaacetic acid, alkyl- or alkenylsuccinic acid, soluble silicates or layered silicates (e.g. SKS-6 from Hoechst) and mixtures thereof. Further chelating agents are described in WO 99/00478.

The enzyme(s) in the liquid detergent may also be stabilized using stabilizing agents in the liquid phase, e.g. a polyol such as propylene glycol or glycerol, a sugar or sugar alcohol, lactic acid, short chained carboxylic acids such as formate or acetate, boric acid, or a boric acid derivative, e.g. an aromatic borate ester, or a phenyl boronic acid derivative such as 4-formylphenyl boronic acid, and the composition may be formulated as described in e.g. WO 92/19709 and WO 92/19708.

Particularly preferred liquid detergents are those containing: long chain (e.g. $C_10$-14) linear alkyl benzene sulphonates in an amount of 5-12%, long chain alkyl, or alkyl ether, sulphates, e.g. with 0-5 ethyleneoxy units, in an amount of 0-3%; fatty acid alkanolamides, and/or alcohol ethoxylates having HLB of less than 12 in an amount of 1-5%; mixtures of mono- and di-long chain alkyl phosphates in an amount of 0-3%, e.g. 0.1-1%; sodium tripolyphosphate (preferably pre-hydrated with from 0.5 to 5% by weight of water) in an amount of 14-30%, e.g. 14-18% or 20-30%; optionally sodium carbonate in an amount of up to 10%, e.g. 5-10% with the total of sodium tripolyphosphate and carbonate being preferably 20-30%; antiredeposition agents such as sodium carboxymethyl cellulose in an amount of 0.05-0.5%; optical brightening agents in an amount of 0.5%-0.5%; chelating agents, e.g. amino phosphonates such as methylene phosphonates of di- and polyamines, especially sodium ethylenediamine tetra[methylene phosphonate] or diethylene triamine hexa[methylene phosphonate] optionally present in an amount of 0.1-15%; together with conventional minor additives such as perfume colouring preservatives, the remainder being water, the percentages being by weight of the total liquid detergent. The liquid detergent may have a pH after dilution to 1% of 6 to 13, preferably 7 to 12, more usually 8 to 11, e.g. 9 to 10.5.

The present invention is further described by the following examples which should not be construed as limiting the scope of the invention.

EXAMPLES

Example 1

Commercially available copolymers of vinylpyrrolidone (VP) and vinylacetate (VA) (random copolymers, all with a K-value around 30 corresponding to a molecular weight around 40.000 g/mol) from BASF, Luviskol VA37 (30% VP+70% VA), Luviskol VA55 (50% w/w VP+50% w/w VA), Luviskol VA64 (60% VP+40% VA), Luviskol VA73 (70% VP+30% VA) and Polyvidon $K_{30}$ (100% VP) was tested according to method 1 with the following ΔNTU result:

| ΔNTU | Ionic strength, mol/kg (using $Na_2SO_4$) | | | | | | |
|---|---|---|---|---|---|---|---|
| Polymer | 0.00 | 0.25 | 0.50 | 1.00 | 1.50 | 2.00 | 4.00 |
| VA37 | P | P | P | P | P | P | P |
| VA55 | 6.3 | 10.2 | 8.1 | P | P | P | P |
| VA64 | 0.2 | 0.2 | 0.1 | 60 | 100 | 105 | P |
| VA73 | 0.1 | 0.2 | 0.1 | 0.0 | 34 | 150 | P |
| PVP K30 | 0.9 | 0.9 | 0.7 | 0.7 | 0.6 | 28 | 32 |

P = forms large aggregates/precipitates (=insoluble)

I.e. according to the definition of soluble/insoluble polymers:

| | Ionic strength, mol/kg (using $Na_2SO_4$) | | | | | | |
|---|---|---|---|---|---|---|---|
| Polymer | 0.00 | 0.25 | 0.50 | 1.00 | 1.50 | 2.00 | 4.00 |
| VA37 | I | I | I | I | I | I | I |
| VA55 | I | I | I | I | I | I | I |
| VA64 | S | S | S | I | I | I | I |
| VA73 | S | S | S | S | I | I | I |
| PVP K30 | S | S | S | S | S | I | I |

S = soluble, I = insoluble

As can be seen from the table only VA64 (containing 60% vinylpyrrolidon and 40% vinylacetate monomers) is both soluble at an ionic strength of 0 mol/kg but insoluble at an ionic strength of 1 mol/kg. VA37 and VA55 are insoluble also in pure water, and VA73 and pure PVP need higher ionic strengths than 1 mol/kg to precipitate.

Example 2

100 g aqueous Savinase concentrate (a protease) with 30% solids was mixed with 6000 g water and 250 g Luviskol VA64 polymer. The solution was spray-dried using a Mobil Minor (spray dryer from Niro A/S) using 165° C. as inlet temperature. 146 grams of the fine powder was mixed with 200 g Whiteway T15 mineral oil to make a slurry of the matrix particles in oil.

The protease activity of the resulting particles were 5 KNPU/g (Kilo Novo Protease Units)

Storage Stability in Detergent:

The stability was tested in a model detergent with the following recipe:

170 g Surfac SLS/BP (anionic surfactant)
100 g Oleic acid
40 g Neodol 25-3 nonion surfactant
50 g Neodol 25-7 nonion surfactant
5 g Na-carbonate
40 g 10N NaOH
42.5 g Citric acid
30 g Sodium-toluene-sulfonate (hydrotrope)
30 g Ethanol
Water ad 1065 g
pH 9.0

The following were added to the detergent:

VA64/Savinase particles from above (5 KNPU/g)

Savinase 16.0 L (16 KNPU/g)—unprotected protease (aqueous solution) as a reference Lipolase 100 L (100 KLU/g)—unprotected lipase (aqueous solution) as "offer" enzyme Savinase were added to a final activity of 0.06 KNPU/g and lipase to a final activity of 0.6 KLU/g. Residual Savinase activity were measured after storage at 35° C. for 7 days and residual Lipolase activity were measured after storage at 30° C. for 3 days.

| Sample | Protease added | Lipase added | Residual Savinase activity | Residual Lipolase activity |
|---|---|---|---|---|
| A | Savinase 16.0 L | Lipolase 100 L | 6% | 20% |
| B | VA64/Savinase particles | Lipolase 100 L | 41% | 43% |

It is clear from the data that encapsulation of the Savinase in the Luviskol VA64 polymer increases the stability of both the protease itself but also other enzymes present (lipase).

The invention claimed is:

1. A liquid detergent composition comprising:

(a) a surfactant in an amount of 30% to 60% by weight of the composition;

(b) water in an amount of 30% to 90% by weight of the composition; and (c) at least one particle comprising an enzyme and a polymer, which has a particle size below 100,000 nm, wherein the enzyme and polymer are present as a mixture in the particle at a polymer:enzyme weight ratio above 1, and the polymer is substantially soluble in an aqueous solution having an ionic strength of 0 mol/kg and insoluble in an aqueous solution having an ionic strength of more than 1 mol/kg and wherein the enzyme is released when the detergent is diluted, and wherein the polymer is a copolymer of between 50 and 70% w/w vinyl pyrrolidone (VP) and 30 to 50% w/w vinyl acetate (VA).

2. The liquid detergent composition of claim 1, wherein the polymer contains 60% w/w VP and 40% VA.

3. The liquid detergent composition of claim 1, wherein the polymer and the enzyme are not covalently bound to each other.

4. The liquid detergent composition of claim 1, wherein the particle size is below 10,000 nm.

5. The liquid detergent composition of claim 1, wherein the particle size is below 1,000 nm.

6. The liquid detergent composition of claim 1, wherein the particle size is less than 500 nm.

7. The liquid detergent composition of claim 1, wherein the particle size is between 50 to 500 nm.

8. A liquid detergent composition comprising:

(a) a surfactant in an amount of 30% to 60% by weight of the composition;

(b) water in an amount of 30% to 90% by weight of the composition; and (c) at least one particle comprising an enzyme and a polymer which has a particle size below 100,000 nm, wherein the enzyme and the polymer are present as a mixture in the particle—at a polymer:enzyme weight ratio above 1, and the polymer is substantially soluble at 25° C. in pure water and insoluble at 25° C. in a mixture with an aqueous solution of $Na_2SO_4$ wherein the mixture contains 1% w/w of the polymer and has an ionic strength of more than 1 mol/kg and wherein the enzyme is released when the detergent is diluted, and wherein the polymer is a copolymer of between 50 and 70% w/w vinyl pyrrolidone (VP) and 30 to 50% w/w vinyl acetate (VA).

9. The liquid detergent composition of claim 8, wherein the polymer contains 60% w/w VP and 40% VA.

10. The liquid detergent composition of claim 8, wherein the polymer and the enzyme are not covalently bound to each other.

11. The liquid detergent composition of claim 8, wherein the particle size is below 10,000 nm.

12. The liquid detergent composition of claim 8, wherein the particle size is below 1,000 nm.

13. The liquid detergent composition of claim 8, wherein the particle size is less than 500 nm.

14. The liquid detergent composition of claim 8, wherein the particle size is between 50 to 500 nm.

* * * * *